United States Patent [19]

Boller

[11] 4,388,046

[45] Jun. 14, 1983

[54] ROTARY COMPRESSORS

[75] Inventor: Edward Boller, Halesowen, England

[73] Assignee: Hydrovane Compressor Company Limited, Worcestershire, England

[21] Appl. No.: 147,528

[22] Filed: May 7, 1980

Related U.S. Application Data

[63] Continuation-in-part of Ser. No. 909,683, May 25, 1978, abandoned.

[30] Foreign Application Priority Data

May 25, 1977 [GB] United Kingdom ..... 22080/77
Jan. 9, 1978 [GB] United Kingdom ..... 714/78

[51] Int. Cl.[3] ..... F04B 49/02; F04B 49/08; F04B 49/10

[52] U.S. Cl. ..... 417/295; 417/290; 417/292; 417/298; 417/307

[58] Field of Search ..... 417/279, 295, 298, 290, 417/302, 307, 310, 292

[56] References Cited

U.S. PATENT DOCUMENTS 2,961,147 11/1960 Osterkamp ..... 417/295
3,059,832 10/1962 Cox et al. ..... 417/295
3,602,610 8/1971 Bloom ..... 417/295 X
3,737,252 6/1973 Pilarczyk et al. ..... 417/295 X
3,788,776 1/1974 Post et al. ..... 417/295
4,068,980 1/1978 Fine et al. ..... 417/295
4,089,623 5/1978 Hofman ..... 417/295

*Primary Examiner*—Richard E. Gluck
*Attorney, Agent, or Firm*—Oblon, Fisher, Spivak, McClelland & Maier

[57] ABSTRACT

A rotary oil sealed compressor including an unloader valve to restrict or close the compressor intake when the compressor pressure rises above the normal working pressure (i.e. when the demand for compressed air drops or ceases) and a minimum pressure valve arranged to ensure that the pressure within the compressor never drops below a predetermined minimum value, further includes venting means responsive to the rise in pressure in the compressed air supply line above a predetermined value exceeding the normal working valve arranged to vent the delivery and compression spaces of the compressor. Thus under no-load conditions the pressure within the compressor is reduced to a relatively low level which considerably reduces the power consumed when the compressor is idling.

3 Claims, 8 Drawing Figures

ROTARY COMPRESSORS

The present application is a continuation-in-part of U.S. Application Ser. No. 909,683, filed on May 25, 1978, now abandoned.

The invention relates to rotary compressors of the oil-sealed type having an unloader valve arranged to restrict or close the compressor intake when the compressor outlet pressure rises above the normal working pressure, i.e. when the demand for compressed air drops or ceases, and a minimum pressure valve arranged to ensure that the pressure within the compressor never drops below a predetermined minimum value.

The air intake is restricted in the off load condition so as to reduce the power which would be wasted by blowing off compressed air when the compressor was called on to supply less than its full rated load. However it has been found that typically 70% of the full load power is consumed due to back pressure effects even when the compressor is supplying no load at all and the unloader valve is blocking the intake.

According to one aspect of the present invention a rotary compressor of oil sealed type including an unloader valve arranged to restrict or close the compressor inlet when the compressor pressure rises above a predetermined value also includes venting means responsive to the rise in pressure in the compressed air supply line above a predetermined value exceeding the normal working value and arranged to vent the delivery and compression space of the compressor, and a minimum pressure valve arranged to close the delivery passage to prevent flow from the supply line back into the delivery space.

In this specification the term supply line pressure refers to the pressure downstream of the minimum pressure valve, compressor pressure refers to the pressure upstream of the minimum pressure valve (i.e. inside the compressor after compression) and inlet pressure refers to the pressure downstream of the unloader valve. The term delivery space is used to denote the space within the compressor occupied by the air after it has been compressed whilst the compression space is that space within which the air is compressed.

Preferably the compressor is of the type in which the oil is circulated by the compressor pressure. In the no-load condition the compressor pressure may be reduced to below 40% of its normal value.

According to another aspect of the present invention a rotary compressor of the oil sealed type includes:

An unloader valve controlling the air inlet and actuated by a piston subject to a pressure controlled by a servo valve which in turn is acted on by compressor pressure opposing a spring.

A minimum pressure valve controls the air delivery and opened by compressor pressure against a spring and a restoring pressure.

Venting means are arranged to vent the delivery and compression space of the compressor and are connected to a change over valve responsive to the supply line pressure to assume an on-load position when the said supply line pressure does not exceed a predetermined value greater than the normal working pressure.

To assume a no-load position when the said supply line pressure exceeds the said predetermined value, in which position it applies compressor pressure as the restoring pressure of the minimum pressure valve and permits the venting means to vent the delivery and compression spaces, the compressor is so constructed that when compressor air is being accepted by a load the change over valve is in the on-load position and the servo valve and unloader valve modulate the inlet to maintain the nominal compressor delivery pressure with the venting means operative and the minimum pressure valve open, whereas when compressed air is not accepted the change-over valve assumes the no-load position, the minimum pressure valve closes the delivery. The venting means operates to vent the delivery and compression spaces and the unloader valve opens to increase the compressor pressure when the latter sinks below a predetermined low value.

Further features and details of the invention will be apparent from the following description of three specific embodiments which are given by way of example only with reference to the accompanying drawings in which.

Figure 1:
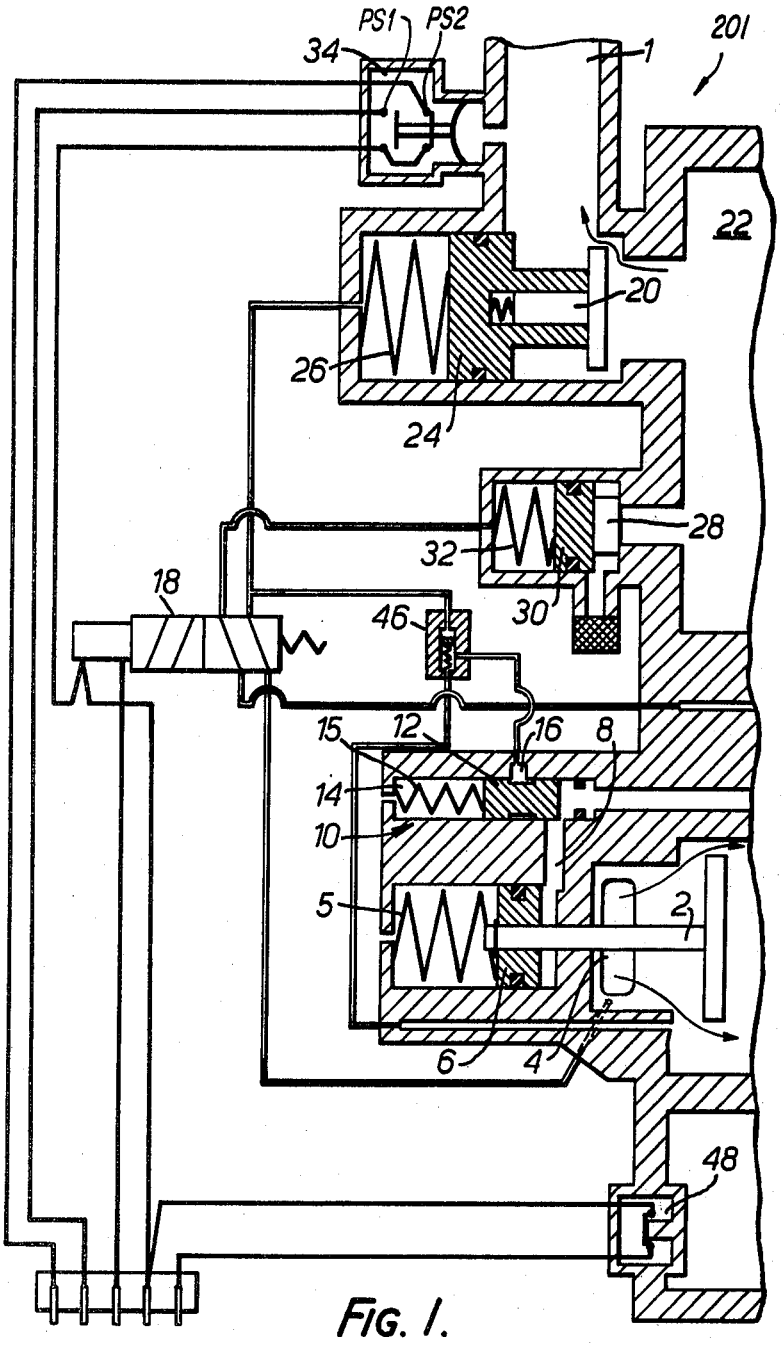
FIG. 1 is a diagram of a part of a compressor in accordance with the present invention during normal on-load operation.
Figure 2:
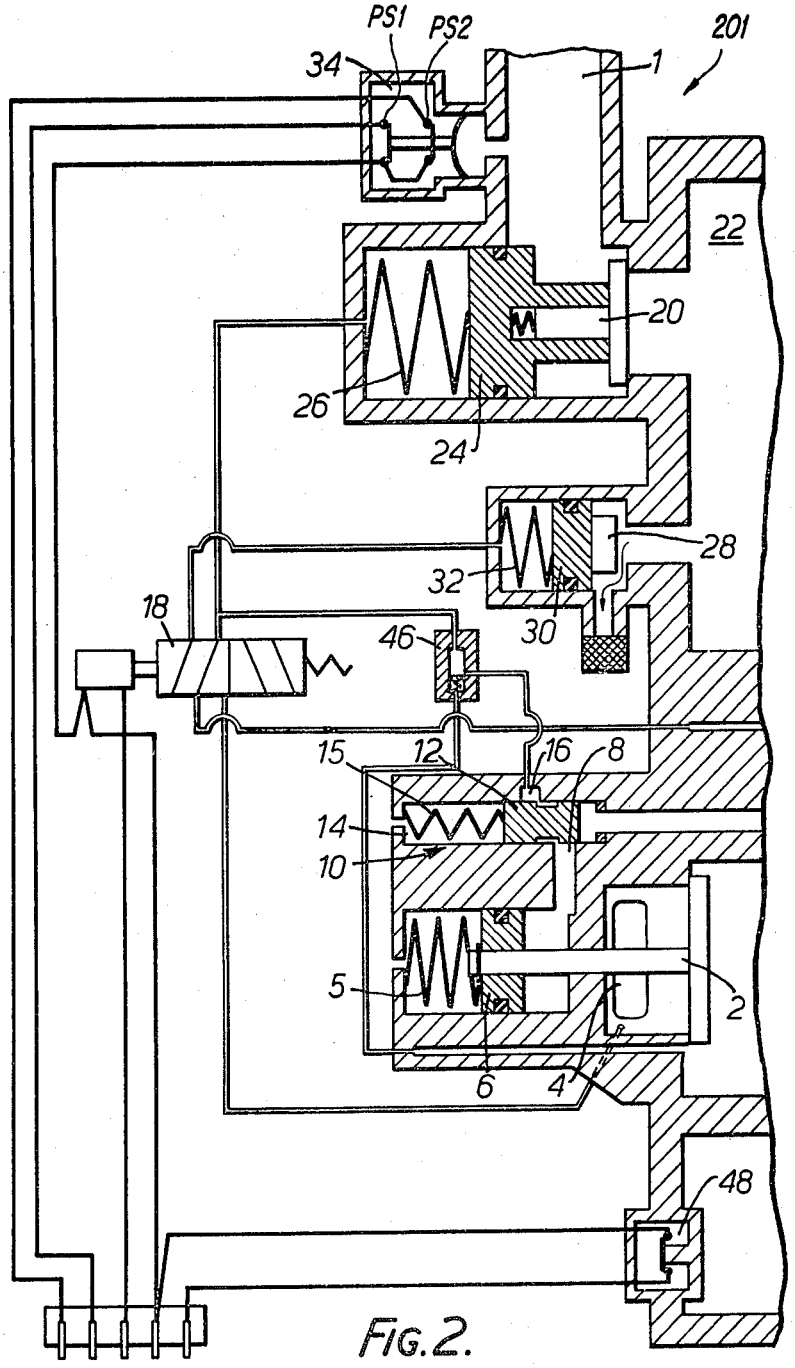
FIG. 2 is a view similar to FIG. 1 showing the compressor during no-load operation.

FIGS. 1 and 2 show a part of a rotary compressor 21 of eccentric rotor sliding vane type designed to deliver air at a normal working pressure of 100 p.s.i. via an oil separator to a supply line 1 and having an unloader valve 2 arranged so as to be capable of restricting and closing the compressor inlet 4 when the demand for compressed air falls. The unloader valve 2 is actuated by a unloader piston 6 one side of which (referred to as the back) is at atmospheric pressure and acted on by a spring 5 while the front communicates with a passageway 8, the pressure within which is controlled by a servo valve, generally designated 10.

The servo valve 10 comprises a valve piston 12 within a cylinder 14, one end of which (referred to as the front end) is at compressor pressure, while the back end, is acted on by a spring 15 exposed to atmospheric pressure. The piston 12 also includes a rear control groove 16 which is connected to a change-over valve 18 as described below.

Situated between the compressor and the compressed air supply line 1 is a minimum pressure valve 20 which prevents the flow of air from the supply line 1 back into the compressor delivery space 22, and ensures that the pressure within the compressor does not fall below the lowest pressure at which the components of the compressor are still satisfactorily lubricated, which may be about 30 p.s.i. The pressure in the delivery space 22 of the compressor tends to hold the minimum pressure valve 20 open. The minimum pressure valve 20 is attached to a piston 24 which is acted on its back side so as to tend to close the valve, by a spring 26, and by a restoring pressure whose magnitude is also controlled by the change-over valve 18.

The compressor delivery space 22 (i.e. on the upstream side of the minimum pressure valve) is provided with a vent valve 28 to vent it to the atmosphere. This valve 28 is connected to a piston 30 and is acted on in the opening direction by the compressor pressure and in the closing direction i.e. on its back side by a spring 32 and a restoring pressure which is also controlled by the change-over valve 18.

Situated in the compressed air supply line 1, downstream of the minimum pressure valve 20 is a pressure switch 34 having contacts PS1 and PS2, connected so as to actuate the change-over valve 18.

The change-over valve 18 controls the restoring pressures of the vent valve 28, the minimum pressure valve 20 and the servo valve 10. In an on-load position shown in FIG. 1 it applies compressor pressure to the back of the vent valve 28, and inlet pressure (i.e. on the downstream side of the unloader valve) to the back of the minimum pressure valve 20 and the rear control groove 16 of the servo valve 10.

Thus with the change-over valve 18 in the on-load position the vent valve 28 is inoperative, being held closed by its restoring spring 32 with the delivery pressure being applied to its front and back surfaces. The unloader valve 2 then operates in the conventional manner. That is to say, when the demand for compressed air decreases the delivery pressure rises above 100 p.s.i. and the servo piston 12 is moved against the force of its restoring spring so as to gradually permit the servo controlled pressure in the passage 8 to act on the unloader valve piston 6 thus gradually closing the unloader valve and thus the compressor inlet. The minimum pressure valve 20 is acted on by the compressor pressure which is opposed only by its restoring spring 26. The valve is thus held open and permits compressed gas to flow into the supply line 1.

In the no-load position shown in FIG. 2 it applies atmospheric pressure to the back of the vent valve 28 which therefore opens and compressor pressure to the back of the minimum pressure valve 20 which therefore closes and to the rear control groove 16 of the servo valve 10.

In normal operation, when the compressor pressure reaches about 105 p.s.i., which occurs when zero load is being taken by the compressor, the unloader valve is fully closed by the controlled pressure from the servo valve. Between delivery pressures of 100 and 105 p.s.i. the unloader valve is modulated to correspond to the demand for compressed air, by action of the servo valve.

When the delivery pressure reaches 105 p.s.i. the pressure in the compressed air supply line 1 also reaches 105 p.s.i. and the contacts of the pressure switch 34 close thus actuating the changeover valve 18.

The changeover valve 18 switches into the no-load condition and the pressures behind the vent valve 28, minimum pressure valve 20 and in the rear control groove 16 are all switched as described above.

The pressure behind the vent valve piston 30 is now atmospheric, and the pressure inside the compressor forces open the vent valve 28 thus venting the delivery and compression spaces to the atmosphere. The vent valve spring 32 is such that the vent valve closes again when the compressor pressure reaches 30 p.s.i. which is approximately the minimum pressure which will ensure that the moving parts of the compressor are satisfactorily lubricated when off-loaded.

The pressure behind the minimum pressure valve piston 24, which is now the compressor pressure, together with the force of the minimum pressure valve spring 26 closes the valve thus ensuring that the supply line pressure is maintained and not vented back to the compressor.

As the compressor pressure falls the servo piston 12 moves under the action of its restoring spring 15 so as to prevent the compressor pressure being communicated directly to the unloader valve piston 6, however the pressure at the servo piston rear control groove 16, which is now equal to the compressor pressure, is now permitted to act on the unloader valve piston. The force exerted by the unloader valve piston spring 5 is such that when the compressor pressure is at its idling value of 30 p.s.i. the unloader valve 2 is just fully closed.

Should the compressor pressure drop below 30 p.s.i. the force acting on the unloader valve piston 6 tending to keep the unloader valve 2 closed is reduced and the unloader valve will then open slightly until the compressor pressure again reaches 30 p.s.i. when the unloader valve again closes.

Should the delivery pressure rise above 30 p.s.i. the vent valve 28 opens until the pressure has fallen to 30 p.s.i. when the vent valve again closes. Thus the compressor "sips" air, and compressor pressure is maintained at about 30 p.s.i.

If the demand for compressed air rises again the pressure in the supply line 1 drops rapidly, the contacts PS1 and PS2 of the pressure switch 34 open, the changeover valve 18 again reverses all the pressure connections and the compressor resumes normal on load operation.

Due to the fact that, when idling, the compressor pressure is only 30 p.s.i. the back pressure on the compressor vanes is reduced and the power consumed whilst the compressor remains in the idling mode is considerably reduced, for instance to about 50% of the previous typical value. A considerable financial economy is thus made over a simple full pressure offloading system.

Figure 3:
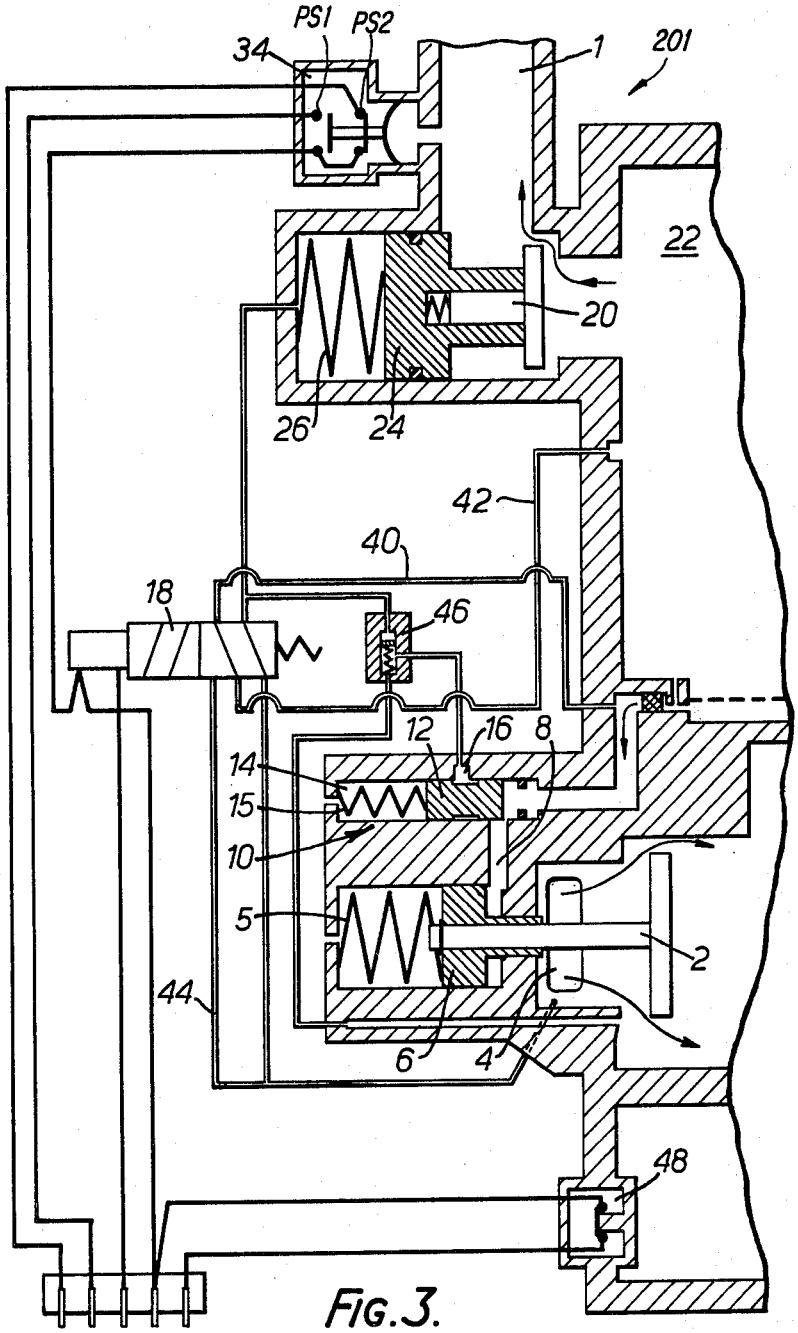
FIG. 3 is a view similar to FIG. 1 showing a modified construction of compressor during on-load operation.
Figure 4:
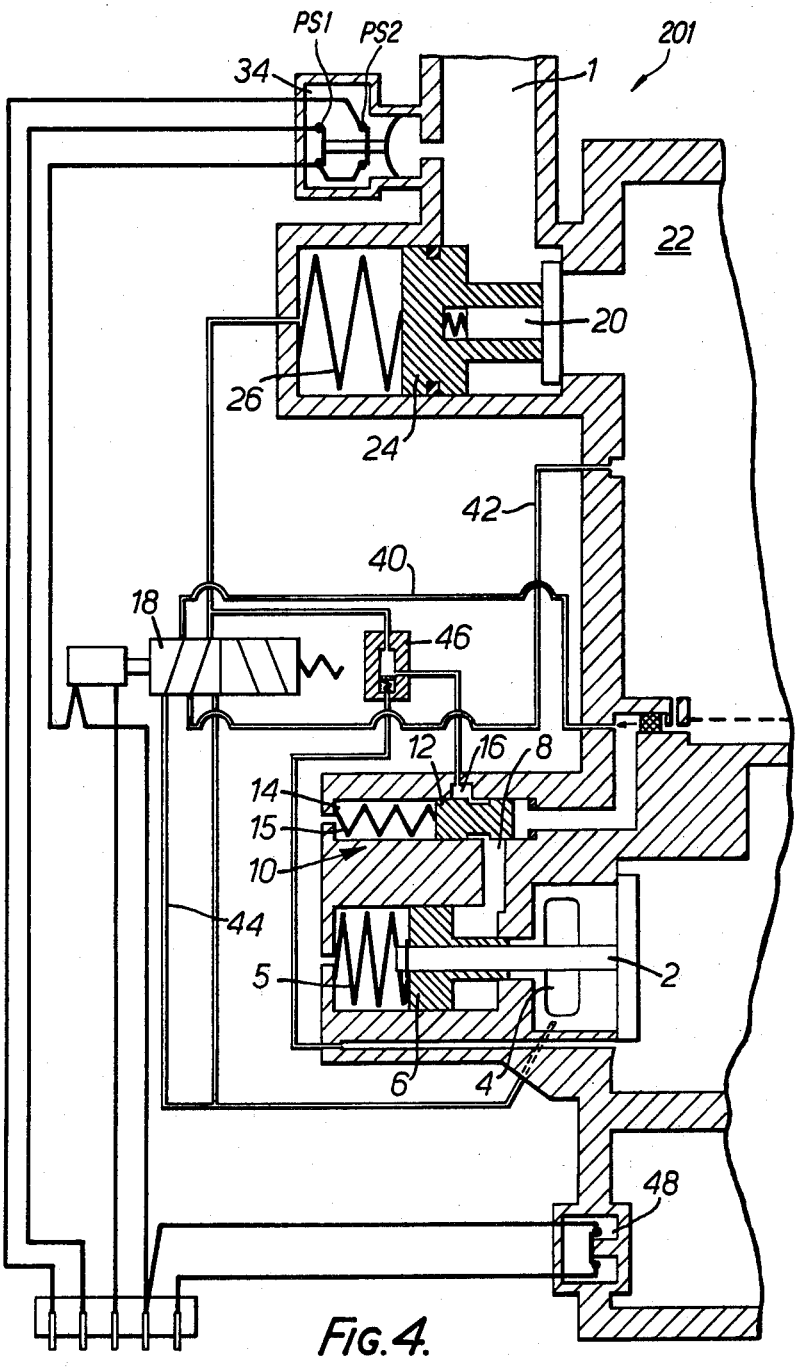
FIG. 4 is a view similar to FIG. 2 showing the compressor of FIG. 3 during no-load operation.

FIGS. 3 and 4 show a modified compressor whose construction and operation are very similar to that of FIGS. 1 and 2, and the same reference numerals are used to designate the same parts. However in this construction the vent valve is omitted and replaced by a vent passage 40 connected to the changeover valve 18.

When the changeover valve is in the on-load position shown in FIG. 3, inlet pressure is applied to the back of the minimum pressure valve 20 and the rear control groove 16, as in the first construction. In addition the vent passage 40 is connected to a passage 42 which also communicates with the delivery and compression spaces of the compressor. During normal operation substantially no air will therefore pass through the vent passage.

When the pressure in the supply line 1 reaches about 105 p.s.i. the change-over valve switches into the no-load condition. The pressure behind the minimum pressure valve 20 and in the rear control groove 16 is switched to be equal to the compressor pressure and the vent passage is connected to the atmosphere. Air is now continually bled from the delivery and compression spaces whose pressure rapidly drops at a rate determined by the dimensions of the vent passage, changeover valve and associated pipework.

As before the minimum pressure valve is maintained closed thus ensuring that the supply line is not vented to the compressor.

As the compressor pressure falls the servo piston moves under the action of the restoring spring so as to prevent the servo controlled pressure being communicated to the unloader valve cylinder, however, the pressure at the servo piston rear control groove, which is now equal to the compressor pressure is not permitted to act on the unloader valve piston. This is sufficient to hold the unloader valve piston closed. The unloader valve piston spring is such that the unloader valve just begins to open when the compressor pressure sinks to about 30 p.s.i. Thus when the compressor pressure drops below 30 p.s.i. the force acting on the unloader valve piston tending to keep the unloader valve closed is reduced and the unloader valve will then open slightly until the compressor pressure again reaches 30 p.s.i. when the unloader valve again closes.

Air is continually bled from the compressor through the vent passage and the unloader valve soon settles to a steady state in which it is slightly open, the flow rate of air which is admitted being equal to the rate at which air is being bled.

The vent passage 40 communicates with the delivery and compression spaces via the final oil separator of the compressor and is connected at the same level as that at which the separated oil normally lies (see dashed line in FIG. 3). Thus in the idling mode any oil which is separated passes down the vent passage. The connection to the atmosphere is by means of a passage 44 which leads to the compressor inlet, so during idling separated oil is returned to the inlet and recycled.

As before, if the demand for compressed air rises again the pressure in the supply line drops rapidly and the compressor resumes normal on-load operation.

It has been found in practice that, even when the demand for compressed air is not zero, the supply line pressure may occasionally rise to 105 p.s.i. due to changes in the load or mere random fluctuations. Thus in both embodiments a timer T1 is preferably coupled between the contacts of the pressure switch 34 and the changeover valve 18 so that the changeover valve is only actuated when the pressure in the supply line exceeds 105 p.s.i. for a certain length of time, conveniently about 20 seconds.

It has also been found statistically that when the demand for compressed air has been zero for about 5 minutes, it is likely to remain so for very much longer. Thus the preferred embodiments also include a second timer T2 coupled to the first timer T1 and the changeover valve 18 so that after the changeover valve has been in the no-load position for about 5 minutes the compressor is turned off completely, effecting even greater economies.

In the preferred embodiments the control function is effected electrically and the changeover valve 18 comprises a two way, four position solenoid valve.

Figure 7:
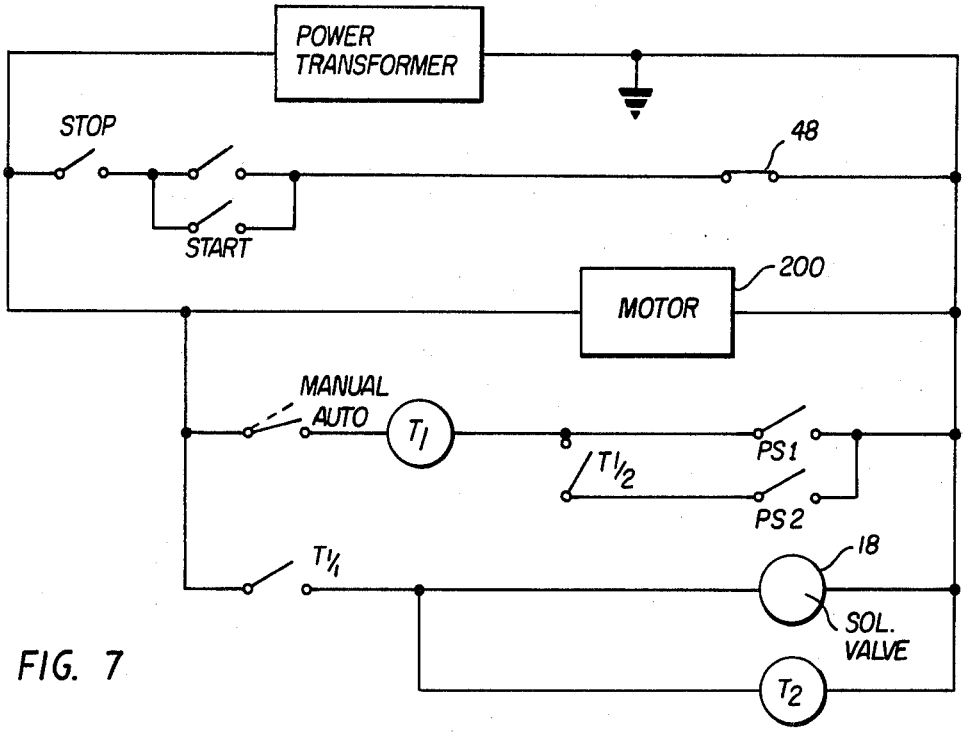
FIG. 7 shows the circuitry of the embodiment of FIGS. 1–4.

FIG. 7 shows the circuitry used in conjunction with the embodiments described in the FIGS. 1–4. As may be seen in FIGS. 1–4, the pressure switch 34 has two sets of contacts. When the compressor is started up the pressure rises and at about 76 p.s.i. one of the two contacts, PS2, closes. At a pressure of about 105 p.s.i. the other of the contacts, PS1, closes (but the unloader valve 2 is not yet fully closed). This starts timer T1 and after twenty seconds contacts T1/2 are closed by time T1 to short the contacts PS1 out of the circuit and contacts T1/1 are closed by timer T1 to switch the solenoid valve 18 into its idling position. This commences the venting operation and closes the unloader valve 2 and also starts the second timer T2. After five minutes T2 switches off the compressor motor 200. If the air demand should resume in these five minutes the contacts PS1 open at about 100 p.s.i. (such switches generally have a differential of several p.s.i. between their opening and closing pressures), but these contacts have been shorted out of the circuit so this has no effect. However, at about 70 p.s.i. contacts PS2 open and normal operation is resumed.

It will be noted from the drawings that both of the described constructions include a flow control valve 46 in the line leading from the changeover valve 18 to the rear control groove 16, which controls the connection of these two components to each other and to the inlet pressure.

As can be seen, when in normal on-load operation shown in FIGS. 1 and 3 the valve connects the rear control groove 16 to inlet pressure whereas during idling operation shown in FIGS. 2 and 4 the valve is acted on by the compressor pressure and moves to permit the compressor pressure to act in the rear control groove. This valve is however not essential and could be omitted leaving the rear control groove connected directly to the changeover valve.

Figure 5:
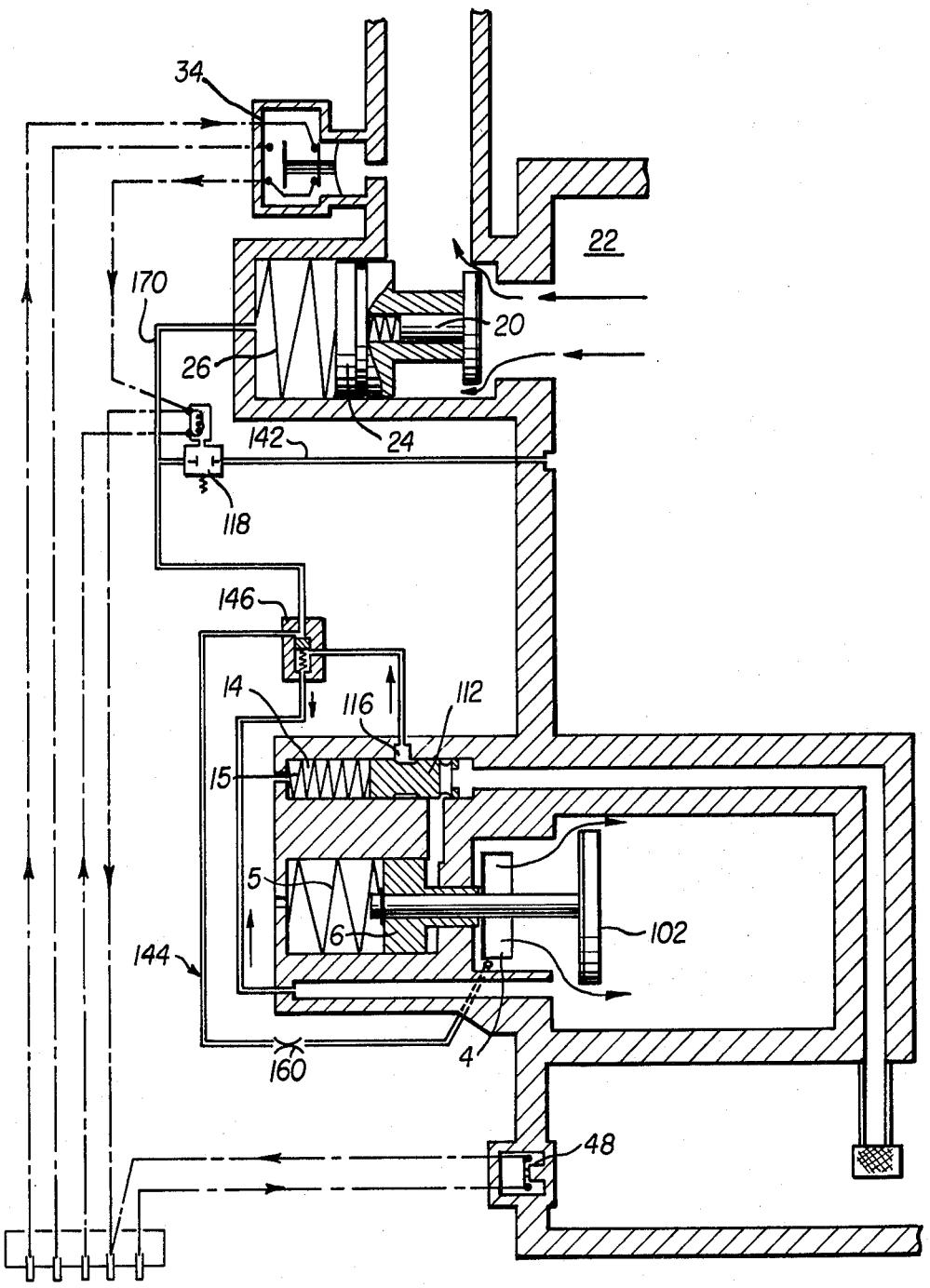
FIGS. 5 and 6 show a further embodiment of the invention.
Figure 6:
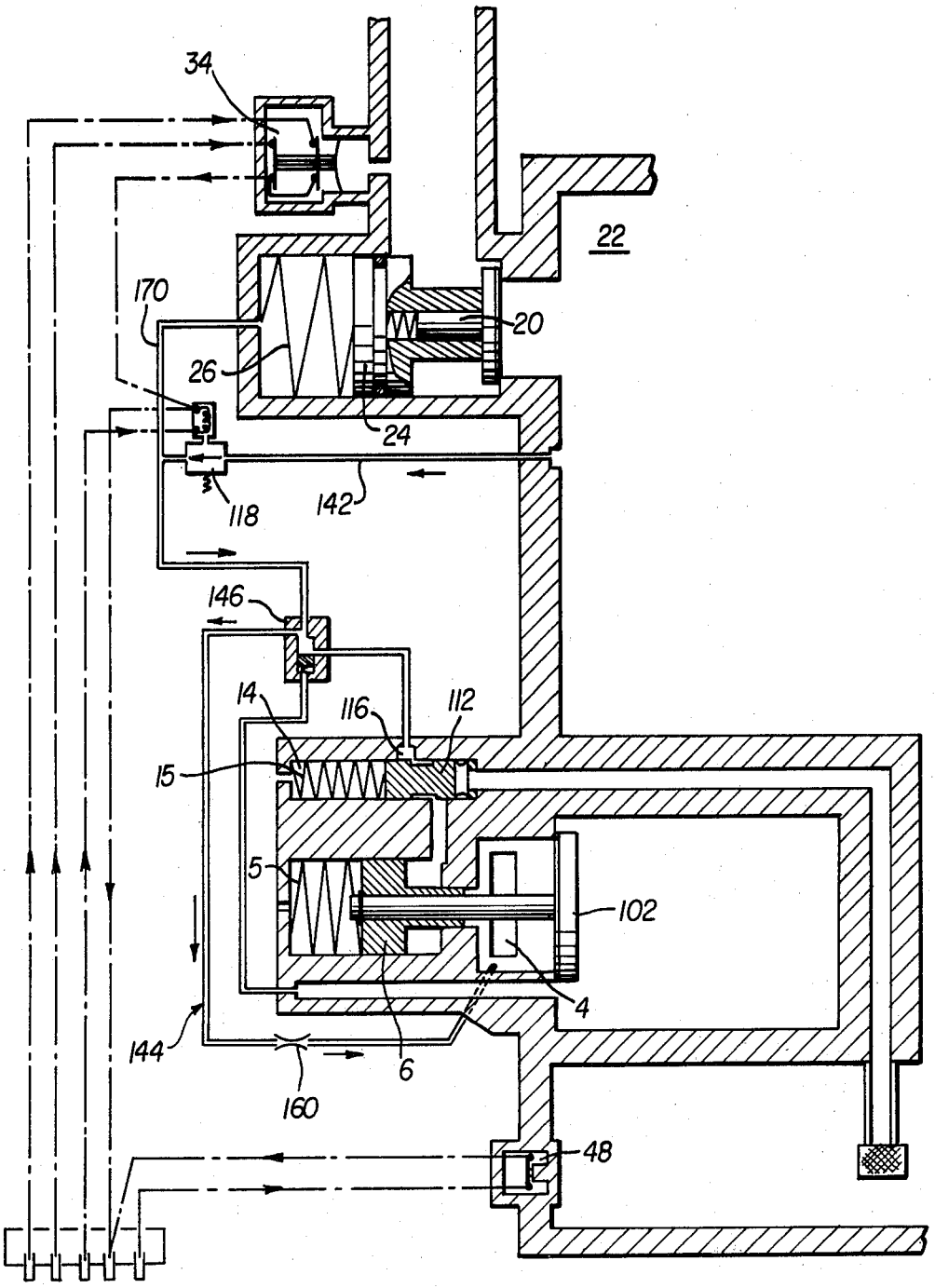

A third embodiment of the present invention is seen in FIGS. 5 and 6, in which the solenoid valve 118 has been simplified to switch only one pressure line instead of two. This is made possible by providing the flow control valve 146 within an additional connection. The operation of the compressor is very similar to that illustrated in FIGS. 3 and 4, the difference being that the passage 142 is the only passage for the solenoid valve 118, while in the idling condition of FIG. 6 the pressure in this line is connected to the rear face of the unloader valve 102 to close it via the groove 116 in the servovalve 112 and the flow control valve 146 as was previously the case. However, the passage 144 through which the compressed gas is vented to the compressor inlet is now connected directly to the flow control valve via flow restriction 160. This enables the solenoid valve to be simpler and thus cheaper and also results in the passage 40 of FIGS. 3 and 4 being rendered superfluous. The structure and operation of this embodiment is otherwise similar to that of FIGS. 3 and 4.

The fourth embodiment, which is not illustrated, is to omit the pressure line 170 leading from the solenoid valve 118 to the back of the minimum pressure valve 20. Apparently the minimum pressure valve can close quite adequately under the influence of its return spring 26, and although the application of compressor pressure to its rear face when the compressor switches into the idling mode results in a very sharp closure of this valve, this feature is not essential.

Figure 8:
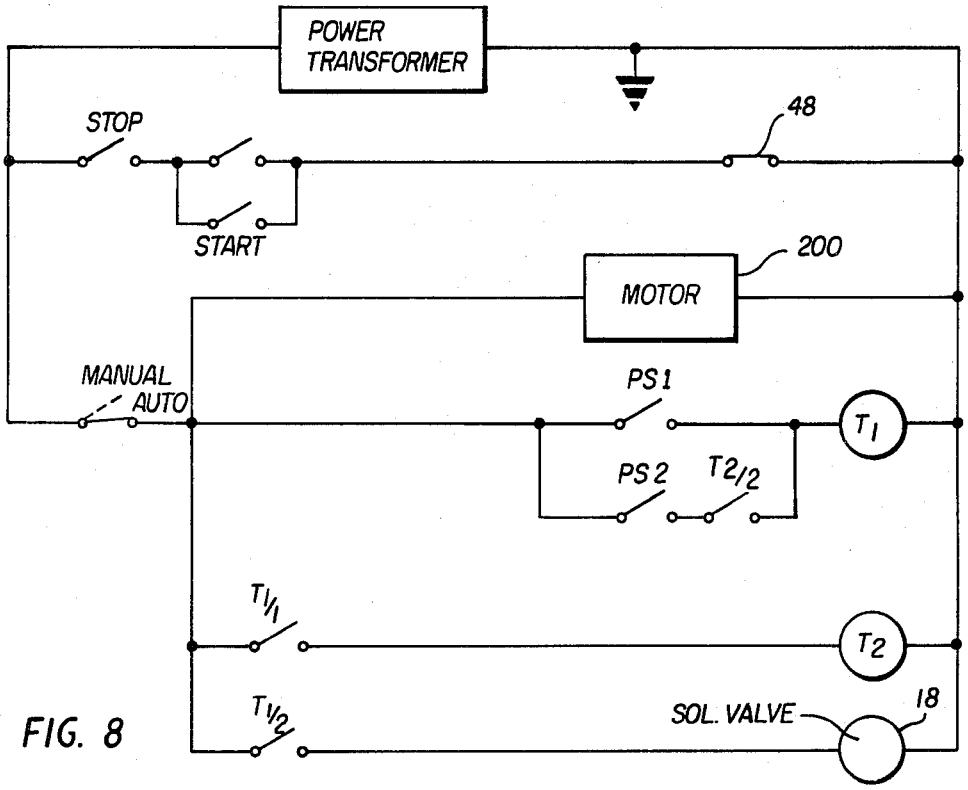
FIG. 8 shows the circuitry of the embodiment of FIGS. 5 and 6.

FIG. 8 shows the circuitry of the embodiment of FIGS. 5 and 6. As before contacts PS2 close at 76 p.s.i., and at about 105 p.s.i. contacts PS1 close and time T1 starts. Simultaneously contacts T1/2 close which immediately switches over the solenoid valve and thus the venting procedure begins and the unloader valve is fully closed. If the no-load condition persists the pressure in the supply line stays at 105 p.s.i. which results in the venting procedure continuing. After twenty seconds the time T1 times out and contacts T1/1 close which energizes the second timer T2 and also closes contacts T2/2 which short out the contacts PS1. If the pressure in the supply main drops below about 70 p.s.i. contacts PS2 open again and the compressor returns to normal operation. However, if the pressure in the supply main should drop below about 100 p.s.i. within twenty seconds, that is to say before the timer T1 is timed out, then contacts PS1 open again, timer T1 switches off, the solenoid valve returns to its original position and normal operation continues.

It may be appreciated that in this embodiment the venting procedure begins immediately when a high pressure is detected and the function of the timer T1 is to decide the "point of no return" before which the compressor can immediately return to normal operation and after which the compressor must at least be vented down to 70 p.s.i. before a return to normal operation can begin. Thus, in normal operation of this embodiment the venting procedure may be started regularly, but provided that a load is actually present in venting procedure will be terminated before the supply line pressure is dropped to 100 p.s.i.

It will be appreciated that a number of modifications or additions may be made to the embodiment described above without departing from the scope of the invention. For instance the pressures mentioned, and the times at which the timers are set, may be varied in accordance with operational convenience. or necessity. The compressor may also incorporate an over-temperature switch 48 which is arranged to switch the compressor off should its operating temperature rise above a predetermined value, thus indicating that a fault has developed. The control function may also be effected other than electrically, for instance by means of pressure lines and fluidic control. Furthermore, the invention is not limited to compressors of the eccentric vane type but may also be applied to compressors of, for example, the screw type.

What is claimed as new and desired to be secured by Letters Patent of the United States is:

1. A rotary compressor of the oil sealed type having an air inlet, an air delivery passage, a delivery space and a compression space, including:

a servo valve;

an unloader valve including a piston and a spring and controlling the air inlet and actuated by said piston subject to a pressure controlled by said servo valve which in turn is acted on by compressor pressure opposing a second spring;

a minimum pressure valve including a third spring controlling the air delivery passage and opened by compressor pressure against said third spring and a restoring pressure;

and venting means arranged to vent the delivery and compression spaces of the compressor and connected to a changeover valve operatively coupled to the pressure in a compressed air supply line to assume an on-load position when the said supply line pressure does not exceed a predetermined value greater than the normal working pressure, and to assume a no-load position when the said supply line pressure exceeds the said predetermined value, in which position it permits the venting means to vent the delivery and compression spaces, the compressor further including pressure sensitive switch means operably connected to said changeover valve so that when compressed air is being accepted by a load the changeover valve is in the on-load position and the servo valve and unloader valve modulate the inlet to maintain the nominal compressor delivery pressure with the venting means inoperative and the minimum pressure valve opened whereas when compressed air is not accepted the change-over valve assumes the no-load position, the minimum pressure valve closes the delivery, the venting means operates to vent the delivery and compression spaces, and the unloader valve opens to increase the compressor pressure when the latter sinks below a predetermined low value.

2. The rotary compressor of claim 1 wherein said venting means applies compressor pressure as the restoring pressure of the minimum pressure valve when said changeover valve assumes said no-load position.

3. A compressor as claimed in claim 1 in which, in the on-load position the changeover valve applies inlet pressure as the restoring pressure for the minimum pressure valve.

* * * * *